US006151921A

United States Patent [19]

Plath

[11] Patent Number: 6,151,921

[45] Date of Patent: Nov. 28, 2000

[54] CIRCULAR KNITTING MACHINE AND SETTING DEVICE FOR ITS CAM SYSTEM PARTS

[75] Inventor: Ernst-Dieter Plath, Albstadt, Germany

[73] Assignee: Sipra Patententwicklungs - U. Beteiligungsgesellschaft mbH, Albstadt, Germany

[21] Appl. No.: 09/184,907

[22] Filed: Nov. 3, 1998

[30] Foreign Application Priority Data

Nov. 8, 1997 [DE] Germany ..... 197 49 470

[51] Int. Cl.[7] ..... D04B 15/34

[52] U.S. Cl. ..... 66/57; 66/19

[58] Field of Search ..... 66/8, 13, 17, 216, 66/57, 78, 19, 38

[56] References Cited

U.S. PATENT DOCUMENTS

| | | | |
|---|---|---|---|
| 3,299,673 | 1/1967 | Noll | 66/57 |
| 3,405,542 | 10/1968 | Beckenstein | 66/57 |
| 3,456,460 | 7/1969 | Mishcon | 66/57 |
| 5,417,086 | 5/1995 | Plath | 66/57 |
| 5,526,655 | 6/1996 | Iida | 66/57 |

FOREIGN PATENT DOCUMENTS

| | | |
|---|---|---|
| 0 694 640 A1 | 1/1996 | European Pat. Off. . |
| 1 122 662 | 1/1962 | Germany . |
| 1 228 746 | 11/1966 | Germany . |
| 1 246 153 | 2/1968 | Germany . |
| 42 40 037 A1 | 6/1994 | Germany . |
| 195 11 949 A1 | 10/1996 | Germany . |

*Primary Examiner*—Danny Worrell
*Attorney, Agent, or Firm*—Michael J. Striker

[57] ABSTRACT

A circular knitting machine comprises a needle cylinder (2) and/or a dial (4) and a cam system (6, 7) associated therewith, said cam system having adjustable cam system parts (32, 33), which are preferably adjustable by rotatable eccentric studs (38) associated therewith. The circular knitting machine moreover comprises in accordance with the invention a setting device (48) which includes actuating members (58) for the eccentric pins (38), wherein the actuating members (58) and the eccentric pins (38) are provided with coupling elements (39, 72), which can be brought into engagement with one another in a defined coupling position. The setting of the cam system parts (32, 33) is effected in that the actuating members (58) are moved suitably after arrangement of the coupling position. The invention further relates to a setting device for this purpose, which can be attached removably to the circular knitting machine. (FIG. 4).

16 Claims, 12 Drawing Sheets

Fig. 7
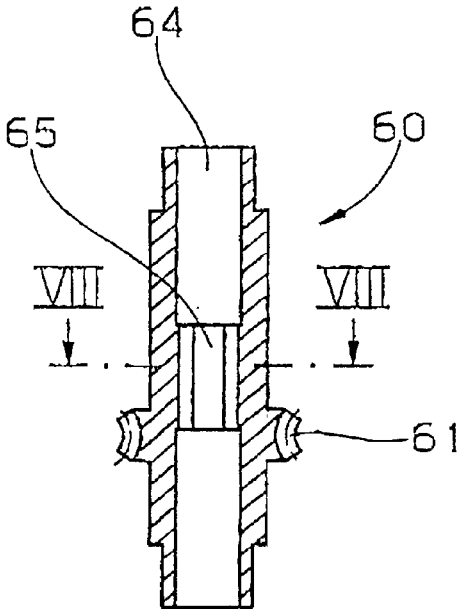
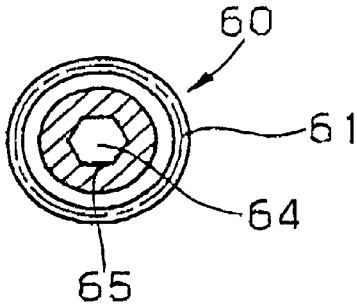
Fig. 8
Fig. 9
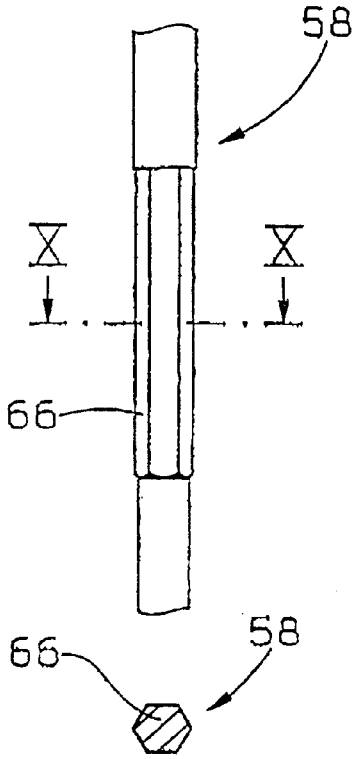
Fig. 10

CIRCULAR KNITTING MACHINE AND SETTING DEVICE FOR ITS CAM SYSTEM PARTS

BACKGROUND OF THE INVENTION

This invention relates to a circular knitting machine with at least one first part in the form of a carrier having knitting implements, a second part in the form of a cam system having cam system groups being distributed along the periphery of the cylinder and having adjustable cam system parts and setting means, and a setting device which can be aligned with the cam system groups and which includes at least one actuating member adapted to adjust the cam system parts in accordance with a pattern.

In multi-system circular knitting machines there is frequently a desire to facilitate the production of different patterns, especially knit patterns, by changing the cam system groups. If a complete change of the cam system arrangements in order to alter the pattern is to be avoided, adjustable cam system parts are provided, which remain in fixed adjustment for the duration of manufacture of a selected knitwear but which can be rapidly switched into another position when needed, in that setting means associated with the cam system parts are operated on with a tool, the setting means consisting of levers, eccentrics or setting pins or the like with inclined surfaces for example. The switching over is effected manually as a rule and with the machine out of operation. Regardless of whether cam system parts are involved in the particular case which move parallel to or perpendicular to the knitting needles (DE 4 240 037 A1 or EP 0 694 640 A1), such switching over can mostly be effected from the outside and without stripping down.

In spite of the setting facilities for the cam system parts, simple in themselves, the conversion of a circular knitting machine is comparatively time-consuming, especially when a multi-system, high capacity circular knitting machine is involved. In a circular knitting machine which has two needle tracks and 72 knitting systems, a complete changeover of all cam system parts takes about two and a half hours and longer for example.

In addition a circular knitting machine of the kind initially referred to is already known (DE-AS 1 122 662), which comprises stationary cam system groups and a rotating setting device with an actuating member in the form of switching rod, which can act on setting means coupled to the cam system parts, in the form of star or cross shaped rotary parts. If the actuating member is located in an operative position produced in accordance with a pattern, it turns the rotary part on through an angular increment of 90° in each case as it passes by a cam system group, whereby the associated cam system part is switched alternately to the one or the other of two possible positions. On the other hand, if the actuating member is in an inoperative position it allows the rotary part to pass by unaffected, so that the cam system part involved remains in that position which had been produced in the preceding passage of the actuating member in the operative position. The setting device is fixed in a circular knitting machine with a rotatable needle cylinder to a machine part rotating therewith, so that it passes all cam system groups distributed in the circumferential direction of the needle cylinder or the dial one after the other and adjusts its cam system parts in accordance with the pattern. In a circular knitting machine with a rotating cam system the setting device would arranged on an immovable machine part, so that the rotating cam system groups would pass by it one after the other. An advantage of such a setting device consists in that the cam system parts can be set automatically in that the actuating member is moved selectively into the operative or inoperative position, e.g. by electromagnets controllable in accordance with the pattern.

In circular knitting machine of the kind described the setting device serves exclusively the purpose of switching the cam system parts during operation into the one or the other position in accordance with the pattern. The setting device would in principle also be suitable for adjusting the cam system parts between two working cycles of the circular knitting machine and thus tool up for the next following working cycle. However the disadvantage would arise with this that the control of the actuating member into its operative or inoperative position would have to be effected not only in dependence on the desired pattern, but also in dependence on which position the cam system part to be switched already arbitrarily occupies. This cannot be effected in practice in multi-system circular knitting machines, because the design of a knitting pattern and the calculation of the pattern data controlling the actuating member required to realise the pattern has to be independent of knowledge of which pattern the circular knitting machine in question was already arbitrarily set to.

Finally circular knitting machines are known (DE-AS 1 228 746, DE-PS 1 246 153) which comprise rotating guide tracks for controlling pivoted levers coupled to the cam system parts or individual pattern drums associated with the knitting systems, which are turned on by a control chain and have pins for setting the cam system parts. Such setting devices are mechanically complex and not usable for high capacity machines.

SUMMARY OF THE INVENTION

The invention is, therefore, based on the object of so designing the circular knitting machine of the kind initially defined that the setting device allows reliable, rapid and largely automatic adjustment of the cam system parts for a new pattern.

A further object of the invention is to design the setting device such that it operates independently of the positions of the cam system parts at the beginning of the setting operation.

Yet another object of the invention is to provide a setting device which can be mounted at choice fixedly or removably on the circular knitting machine.

A still further object is to design the setting device such that it can be mounted removably and can be used to equip a plurality of circular knitting machines of the same type when there is need to tool them up for a new pattern.

These and other objects are solved by a knitting machine wherein the setting means and the actuating member comprise in accordance with this invention coupling elements associated with one another, which can be brought into engagement with one another in a defined coupling position, after alignment of the setting device with one of the cam system groups by movement of the actuating member into the operative position, and the setting device comprises means for setting each cam system part by movement of the actuating member after the coupling has been made.

In contrast to the setting device of the circular knitting machine of the type defined, the setting device according to the invention is provided with an actuating member which can be brought into engagement with the setting means of the cam system part to be switched in a defined coupling position each time. The setting of the actuating member after its coupling with this setting means is thus a measure of its current position and thus a measure of the current actual setting of the earn system part. The cam system part can therefore either be left in its current position, in dependence on the pattern to be set up, if this already corresponds to the position to be produced in accordance with the pattern, or if this is not the case, it can be brought into a new set position, without knowledge of which position the cam system part had at the beginning of the setting operation being necessary.

Further advantageous features of the invention appear from the dependent claims.

BRIEF DESCRIPTION OF THE DRAWINGS

The invention will be described in more detail below with reference to the accompanying drawings, in which a embodiment of the invention and parts thereof are shown as is convenient to different scales and in which;

FIGS. 7 to 10 show details of the setting device according to FIG. 6, where FIGS. 7 and 9 are longitudinal sections and FIGS. 8 and 10 are sections along the lines VIII—VIII and X—X of FIGS. 7 and 9;

DESCRIPTION OF PREFERRED EMBODIMENTS

Figure 1:
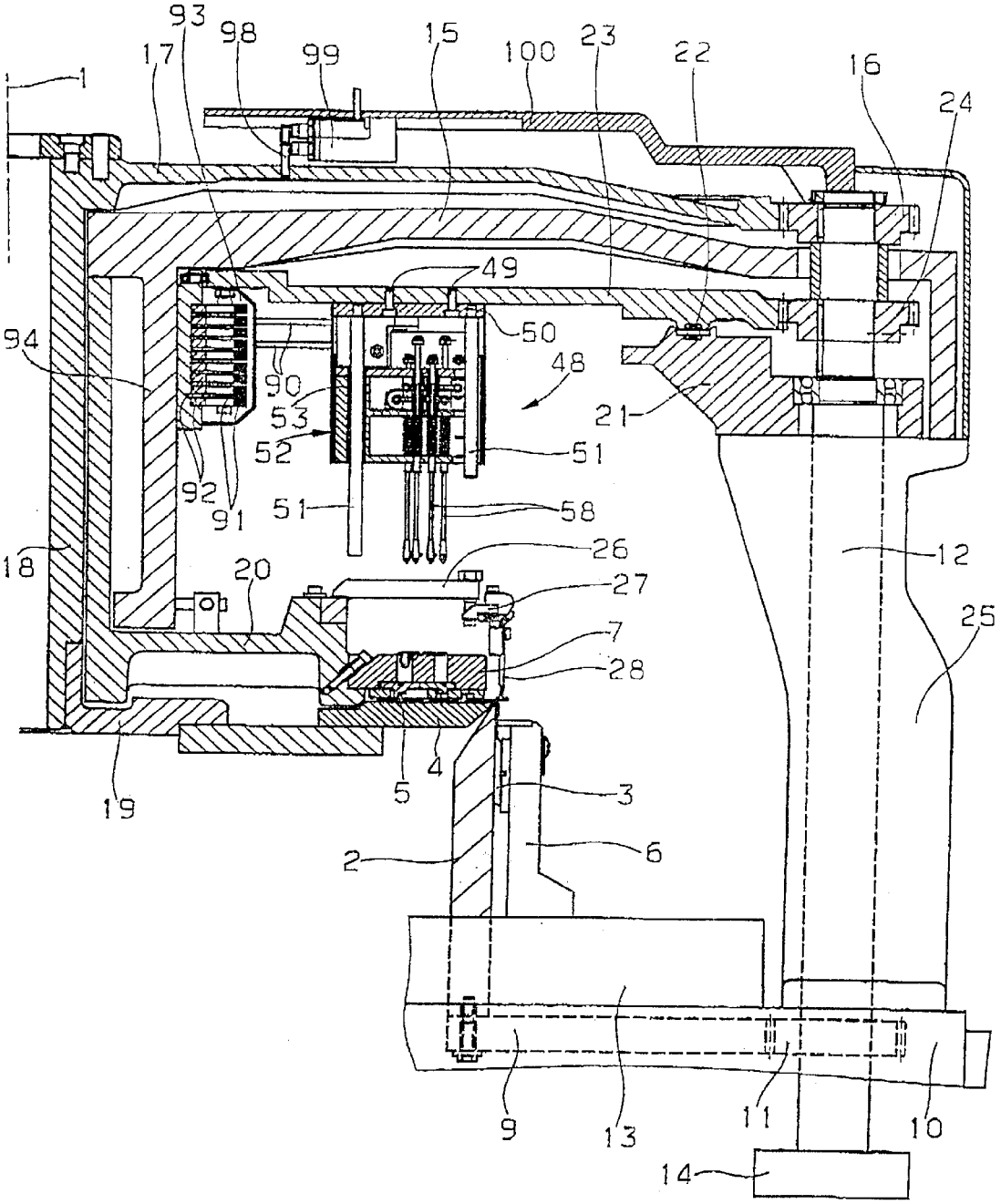
FIG. 1 is a vertical radial section through a circular knitting machine with a setting device according to the invention.

The circular knitting machine according to FIG. 1 comprises a needle cylinder 2 having a vertical axis of rotation 1, with axially movable knitting implements 3 mounted therein and a dial 4 coaxial therewith with radially movable knitting implements 5 mounted therein. In order to control the up and down movement of the knitting implements 3 and the radial in and out movement of the knitting implements 5, these are provided in known manner with butts, not shown in detail, on which cam system parts act, these being fitted in a cylinder cam system 6 surrounding the needle cylinder 2 and a dial cam system 7 mounted above the dial 4.

The needle cylinder 2 is supported coaxially on a support ring 9, which is mounted rotatably in a base plate 10 of a frame, not shown, and is provided with teeth on its periphery, which are in engagement with a gear wheel 11, which is fitted on a vertical drive shaft 12 mounted rotatably in the frame. On the other hand the cylinder cam system 6 is arranged on a stationary cam system plate 13 arranged stationary in the frame and coaxial with the needle cylinder 2. The drive shaft 12 is connected to a drive 14 for the knitting machine, shown only schematically and as a rule in the form of an electric motor.

The drive shaft 12 passes above the needle cylinder 2 through a stationary support plate 15 and is provided with a pinion 16 on its end projecting therethrough, which engages with a drive gear 17 rotatably mounted above the support plate 15 and fixed on a further drive shaft 18 mounted rotatably in the centre of the circular knitting machine, coaxial with the axis of rotation 1. This carries a support plate 19 on its lower end in usual way, on which the dial 4 is mounted, while the support plate 15 has a carrier 20 on its lower end, on which the dial cam system 7 is fixed.

A ring-shaped carrier 21 is stationary fixed in a part of the frame located above the needle cylinder 2 and below the supporting ring 15, and a further support plate 23 coaxial with the needle cylinder 2 is mounted rotatably thereon by means of bearings 22. Plate 23 is provided with teeth on its outer periphery, which mesh with a pinion 24 which is fixed on the drive shaft 12, which passes through a column 25 of the frame fixed to the support 21 and also serves to drive the support plate 23 at a speed which corresponds to the speed of the cylinder.

A further support ring 27 is fixed on the support 20 by means of plurality of spokes 26, which are arranged radially and spaced apart in the circumferential direction of the dial 4, and this ring carries the yarn guides 28 which feed at least one yarn, not shown; to the knitting implements 3 and 5 at each knitting system.

In the preferred embodiment the needle cylinder 2, the dial 4 and the support plate 23 are mounted rotatably while the cam systems 6 and 7 and the support plates 20 and 27 are arranged stationary in the frame. Alternatively however, it could also be provided that the needle cylinder 2, the dial 4 and the support plate 23 are stationary and instead of these the cam systems 6, 7 and the support plates 20, 27 are mounted rotatably in the frame.

Circular knitting machines of this kind are generally known to the man skilled in the art (e.g. DE 195 11 949 A1) and do not therefore need to be described in more detail.

Figure 2:
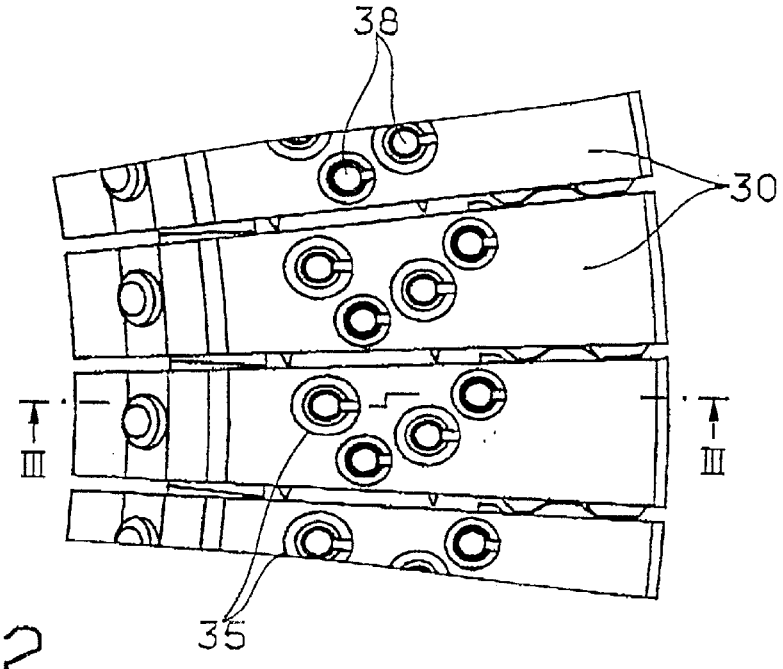
FIG. 2 is view of several adjacent cam system groups for the dial of the circular knitting machine according to FIG. 1.
Figure 3:
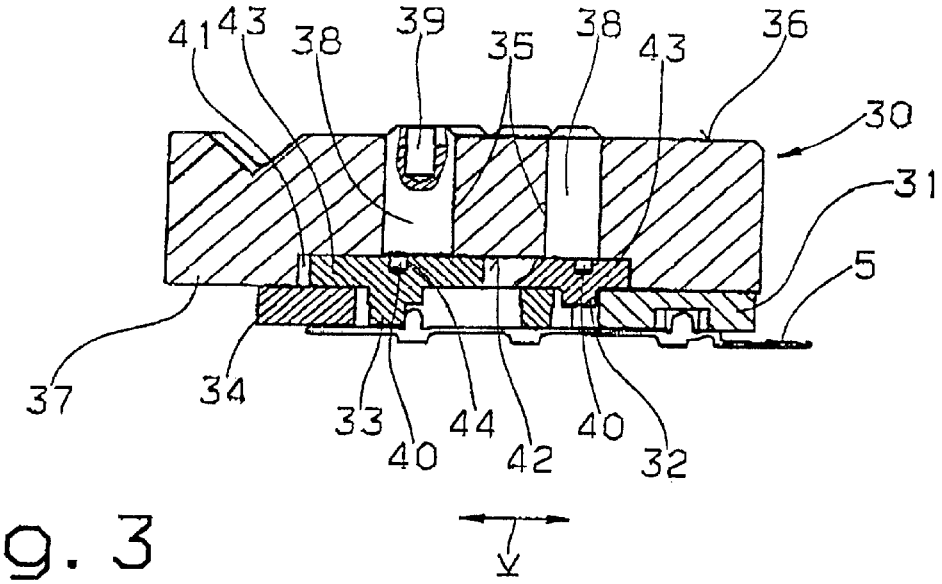
FIG. 3 is a section along the line III—III of FIG. 2, including a schematically indicated knitting implement.

FIG. 2 is a view from above of four segments or cam system groups 30 of the dial cam system 7 arranged alongside each other on a circular track, while a section through a single segment 30 is shown in FIG. 3. Each segment 30 is associated with a system of the circular knitting machine and provided with all cam system parts 31 to 34 which are required to control the associated knitting implements 5, here ordinary rib needles. Each segment 30 in the embodiment has four through-going, cylindrical bores 35, which adjoin the rear side of the segment 30 and whose axes run perpendicular to the knitting implements 5, which are arranged at a front side 37 of the segment 30 and are guided in tricks of the dial 4. Cylindrical setting means 38 are rotatably mounted in the bores 35, in the form of eccentric studs, which have coupling elements 39 on their rear ends, which can be brought into engagement with associated coupling elements of an actuating member, as explained in more detail below. The setting means 38 are provided with projecting eccentric pins 40 on their front ends, arranged parallel to the axial direction but eccentric to the axis.

The segment 30 has a recess 41 in its front side 37, with a rectangular cross-section and which is provided with parallel side surfaces, acting as guide surfaces, and a bottom 42 (FIG. 3), at which the bores 35 end. The outline of the recess 41 is so selected that it surrounds the four eccentric pins 40, which project in the assembled state beyond the bottom 42 of the recess 41. The depth of the recess 41 measured from the front side 37 corresponds to part only of the spacing of the rear side 36 from the front side 37, i.e. only to a part of the thickness of the segment 30. The recess 41 (FIG. 3) of the segment 30 serves to receive elongated guide bars 43 arranged with their axes parallel to the longitudinal direction, on which adjustable cam system parts of the respective segment 30, e.g. the cam system parts 32 and 33, are fixed by screws, welding or the like, although the guide bars 43 and cam system parts 32 and 33 could also be made in one piece.

In the embodiment according to FIGS. 1 to 3 each segment 30 has two cam system parts 32 and two system parts 33, i,e. four adjustable cam system parts in all, of which only two are visible in FIG. 3. The other cam system parts 31, 34 and other cam system parts, not shown, are of no importance to the invention and are for example mounted immovably on the segment 30. The guide bars 43 are each connected to one of the cam system parts 32, 33 and are so formed that four guide bars 43 can be arranged alongside one another in each segment 30. Each segment correspondingly has four bores 35, as FIG. 2 in particular shows and setting means 38 fitted therein, each in operative engagement with a corresponding guide bar 43.

In the described embodiment a setting of the cam system parts 32, 33 is possible in dependence on whether the knitting implements are to be guided into a miss, tuck or knit track. This setting is effected in that the guide bars 43 are shifted within the recess 41 parallel to the knitting implements 5, i.e. parallel to a double arrow v (FIG. 3). To this end the guide bars 43 are provided on their rear sides with transversely extending control grooves 44 (FIG. 3). These are each formed in such a position that, after fitting the guide bars 43 in the recess 41 of the segment 30, they receive therein the eccentric pin 40 of an associated setting means 38. If then the associated setting means 38 is turned in one or the other direction from the outside, this automatically results in displacement of the guide bar 43 and with it the cam system part 32, 33 parallel to the arrow v. Such a setting means 38 is associated with each of the four guide bars 43 arranged in a recess 41, so that all four cam system parts 32, 33 can be set independently of one another. This arrangement is advantageously the same in all segments 30. Moreover, it will be understood that cam system parts could alternatively be provided which serve other purposes and for example call only effect control of the knitting implements into knitting and miss tracks.

Cam system arrangements of this kind are generally known (DE 4 240 037 A1) and do not need to be explained in more detail to the man skilled in the art.

For the purpose of automatic or at least partially automatic setting of the cam system parts 32, 33, the circular knitting machine according to the invention comprises a setting device 48 (FIGS. 1, 4 and 6), which includes a base plate 50, which is fixed on the support plate 23 itself, or a component attached thereto, by means of screws 49. A plurality of downwardly projecting guide rods 51 are fixed on this, disposed parallel to the axis of rotation 1, with a carriage 52 slidably guided thereon. The carriage 52 includes a frame 53 which comprises guide bushes 54 guided with a sliding fit on the guide rods 51 and three plate-form frame parts 55, 56 and 57 running perpendicular to the axis of rotation 1 and spaced one above the other, in which in the embodiment four parallel, rod-formed actuating members 58 for the cam system parts 32, 33 are held.

Figure 4:
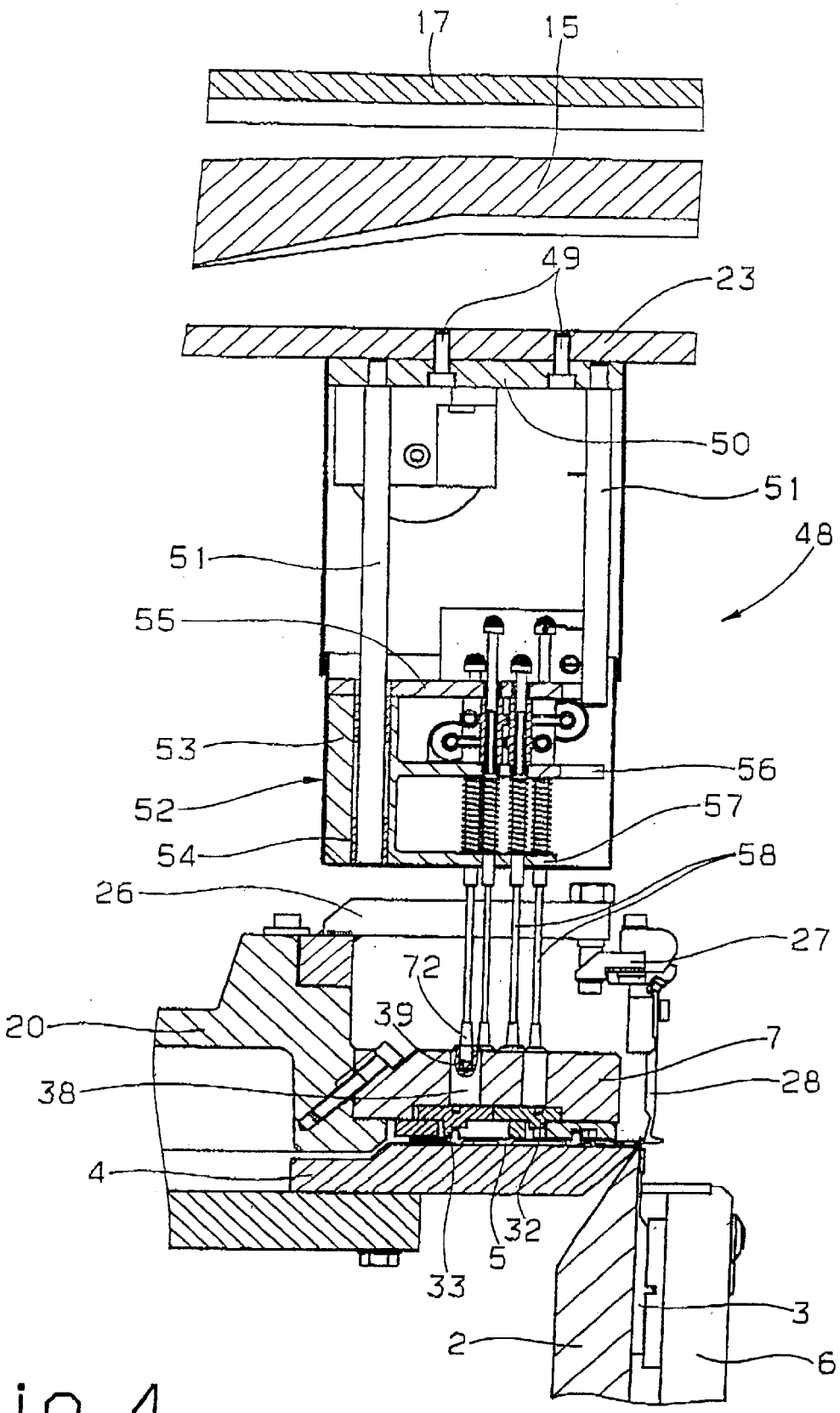
FIG. 4 shows the setting device in a sectional view similar to FIG. 2 but in an operative position.

The carriage 52 can be moved to and fro along the guide rods 51 between a fully raised position shown in FIG. 1 and a fully lowered position shown in FIG. 4. The actuating members 58 assume an inoperative position in the fully raised position of the carriage 52, as FIG. 1 shows. They are then so high above the dial cam system 7 that their lower ends lie above the spokes 26. In this carriage position the support plate 23 and the setting device 48 therewith can be turned arbitrarily about the axis of rotation 1 and relative to the dial cam system 7. On the other hand the setting device 48 is arranged so closely above the dial cam system 7 in the fully lowered position of the carriage 52, as FIG. 4 shows, that the lower, free ends of the actuating members 58 can be brought into engagement with the coupling elements 39 of respective associated setting means 38, as is shown in partial section for the actuating member shown farthest to the left in FIG. 4. This position corresponds to the operative position of the actuating members 58.

Figure 5:
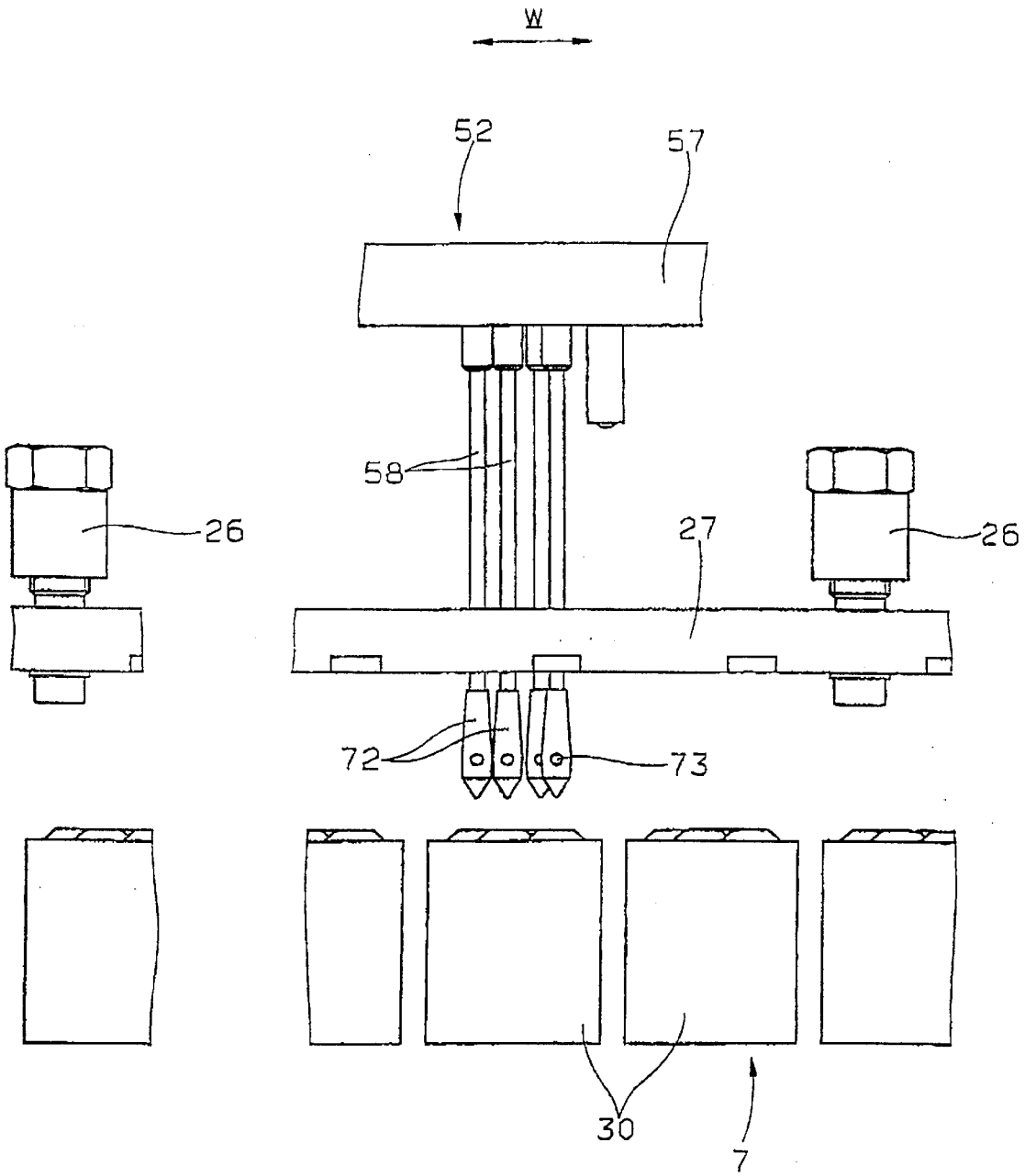
FIG. 5 is a highly schematic representation of the setting device of the circular knitting machine according to FIG. 1 in a view from the outside.

FIG. 5 shows a partial view of the circular knitting machine radially from the outside, i.e. from the right in FIG. 4 at a point between two yarn guides 28, not shown here. The carriage 52 and the actuating members 58 are here shown in an intermediate position, such that the lower ends of the actuating members 58 are above the segments 30 but below the plane of the support ring 27 for the yarn guides 28. In this intermediate position relative movement between the support plate 23 and the dial cam system 7 in the direction of a double arrow w can only take place in the restricted angular region bounded by two spokes 26.

Details of the setting device 48 according to the invention are explained in more detail below with reference to FIGS. 6 to 13.

Figure 6:
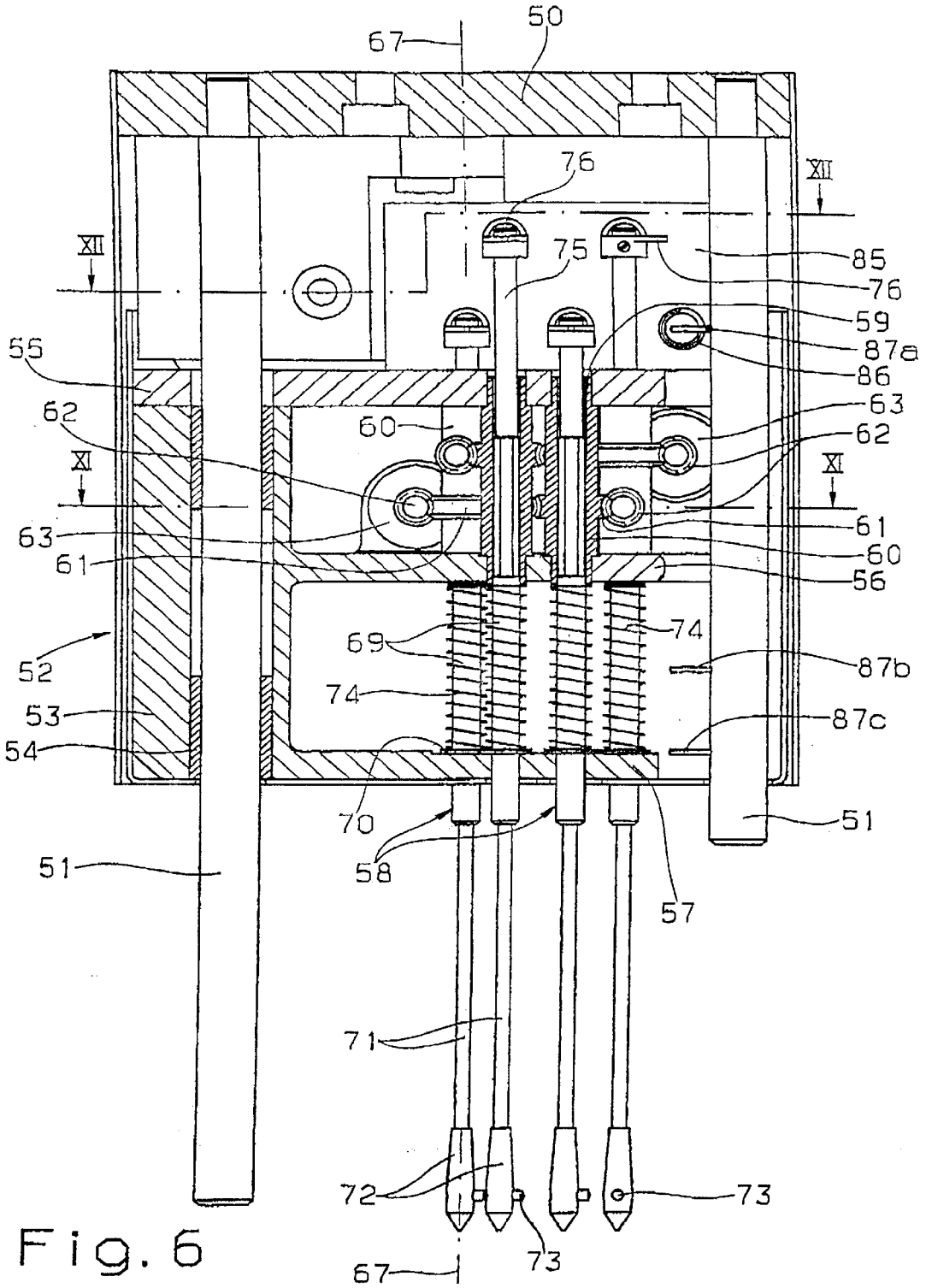
FIG. 6 is a section like FIG. 1 through just the setting device according to the invention.

According to FIGS. 6 to 10 the frame parts 55, 56 and 57 are provided with passages aligned with one another, where the passages in the frame part 55 are given the reference numeral 59 according to FIG. 6. The passages 59 and the passages in the frame part 56 in alignment therewith serve in each case for axially immovable but rotatable mounting of the cylindrical ends of a drive sleeve 60 (FIGS. 6, 7, 8), on the outer periphery of which a worm wheel 61 is fixed in each case, which can for example be made in one piece with a drive sleeve 60 from an injection moulded plastics part. Each worm wheel 61 engages with an associated worm 62, which is mounted on the drive shaft of an associated actuating motor 63 fixed on the carriage 52. Two worm wheels 61 are shown in section in FIG. 6 and two worm wheels 61 in front view. According to FIGS. 7 and 8 inner hollow spaces 64 of the drive sleeves 60 are formed cylindrically for example but are provided over part of their length with a section 65 which is not round, here having a hexagonal cross-section.

The actuating members 58 preferably consist according to FIGS. 6, 9 and 10 of cylindrical rods, whose outer cross-sections correspond essentially to that of the hollow spaces 64 of the drive sleeves 60 and are thus provided in a middle region with a section 66 which has the same cross-section as the section 65, i.e. here of hexagonal form (FIG. 10). According to FIG. 6 the actuating members 58 are so fitted in the drive sleeves 60 that their sections 66 come to lie in the sections 65. If therefore any of the actuating motors 63 is turned on, the corresponding drive sleeve 60 and accordingly also the actuating member 58 mounted therein are set in rotation about their common axis 67 (FIG. 6) parallel to the axis of rotation 1 (FIG. 1) through the associated worm 62 and the associated worm wheel 61. It will be understood that the cross-sections of the drive sleeves 60 and the actuating members 58 could be chosen to be other than hexagonal and the drive forces of the actuating motors 63 could be transferred to the actuating members 58 in other ways, e.g. with the aid of serrations, spur gears or in any other way.

As FIG. 6 in particular shows, central sections 69 of the actuating members 58 project down from the drive sleeves 60. They moreover pass through the corresponding passages in the frame part 57 and are supported on the edges of these passages facing the frame part 56 through a change in diameter formed by a flange 70 or the like. Furthermore the sections 69 are each provided on their ends projecting down out of the frame part 57 via further sections 71 with a coupling element 72 in the form of thicker, conically shaped, pointed shank, which has a radially projecting pin 73. Finally a helical spring 74 is fitted over each section 69, with its one end bearing on the flange 70 while the other end bears on the frame part 56. The actuating members 58, which are axially movable in the drive sleeves 60 but are not rotatable relative thereto, are thus biased axially in the direction of the frame part 57, so that their flanges normally bear against this.

The actuating members 58 according to FIG. 6 project at their upper ends with end sections 75 extending out of the drive sleeves 60 and the frame part 55. These end sections 75 are each provided with a radially extending switch flag 76, which serves to detect the position or rotational setting of the actuating member 58, as is further described below. In order that the switch flags 76 shall not interfere with each other during rotation of the actuating members 58, the end sections 75 preferably have different lengths or the switch flags are provided at different heights on the end sections 75.

Figure 11:
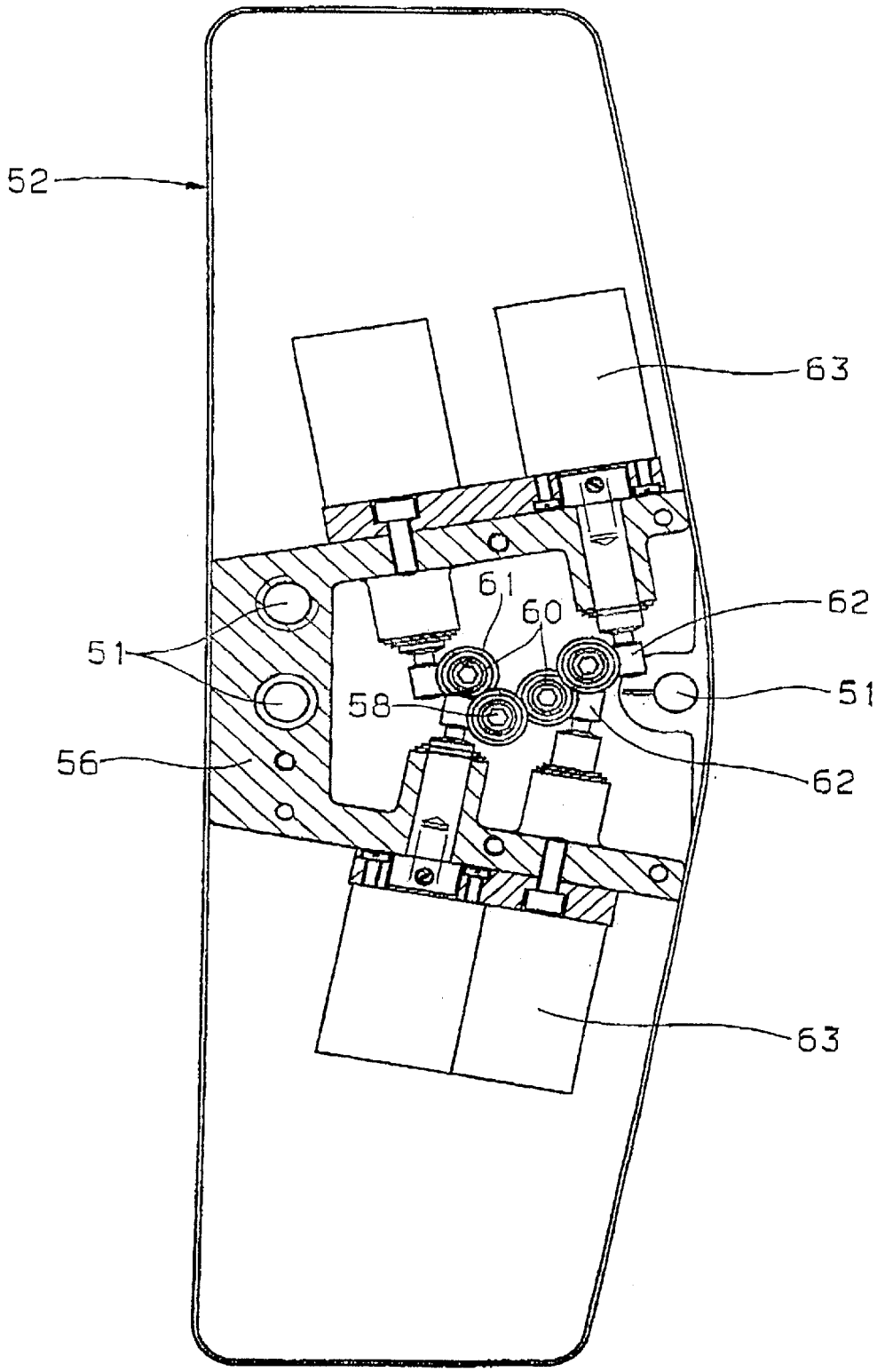
FIGS. 11 and 12 are schematic sections along the lines XI—XI and XII—XII of FIG. 6.

As FIGS. 4, 6 and 11 in particular show, the axes 67 of the four actuating members 58 present are so spaced and arranged relative to one another that the coupling elements 72 thereof have the same distances from one another and are disposed relative to one another just as applies to the setting means 58 (FIGS. 2, 3). The axes of the worms 62 and the actuating motors 63 are so fixed in suitable walls of the frame 53 that all four actuating members 58 can always be rotated simultaneously but independently of one another, without mutual interference.

Figure 12:
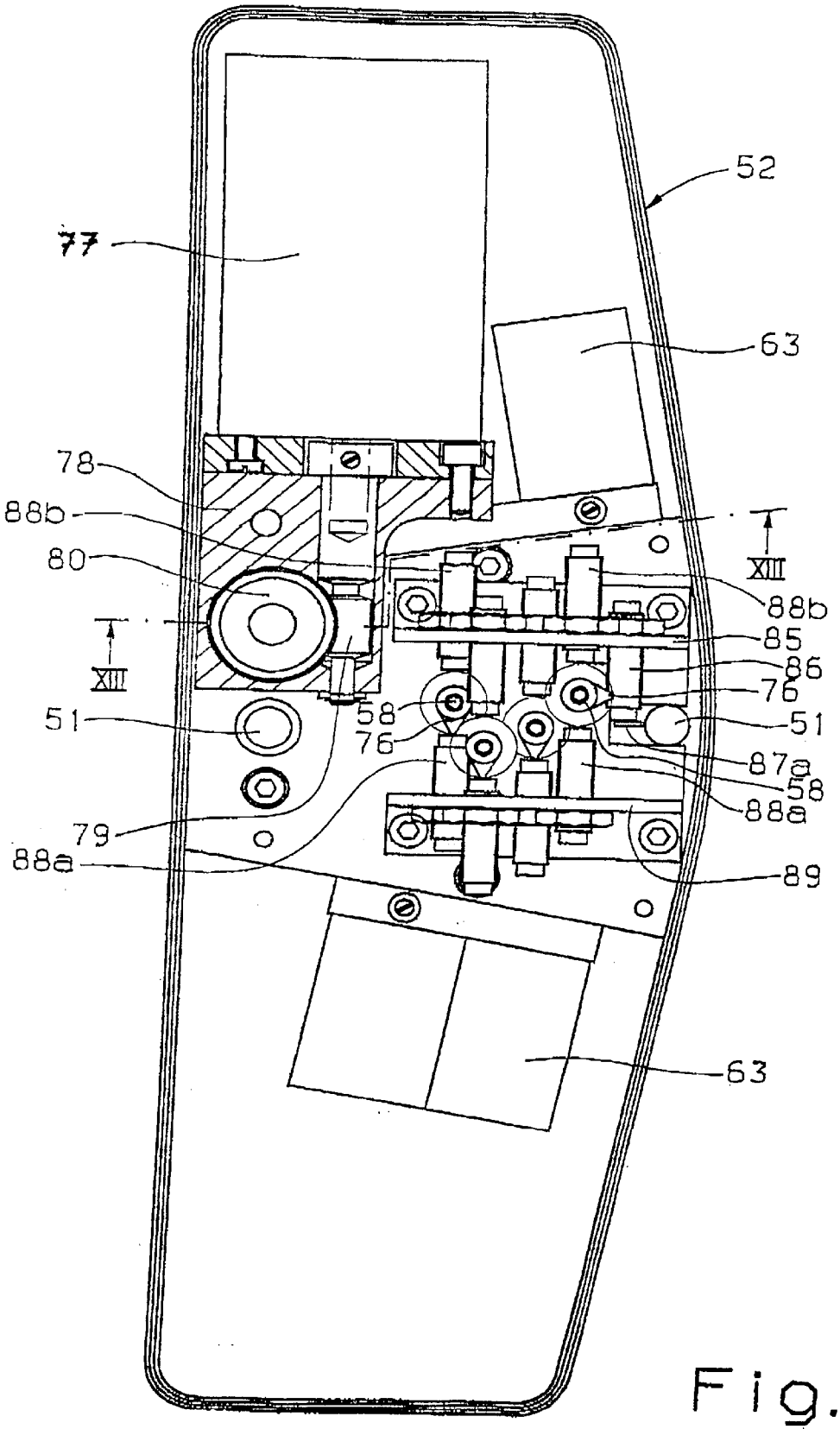
Figure 13:
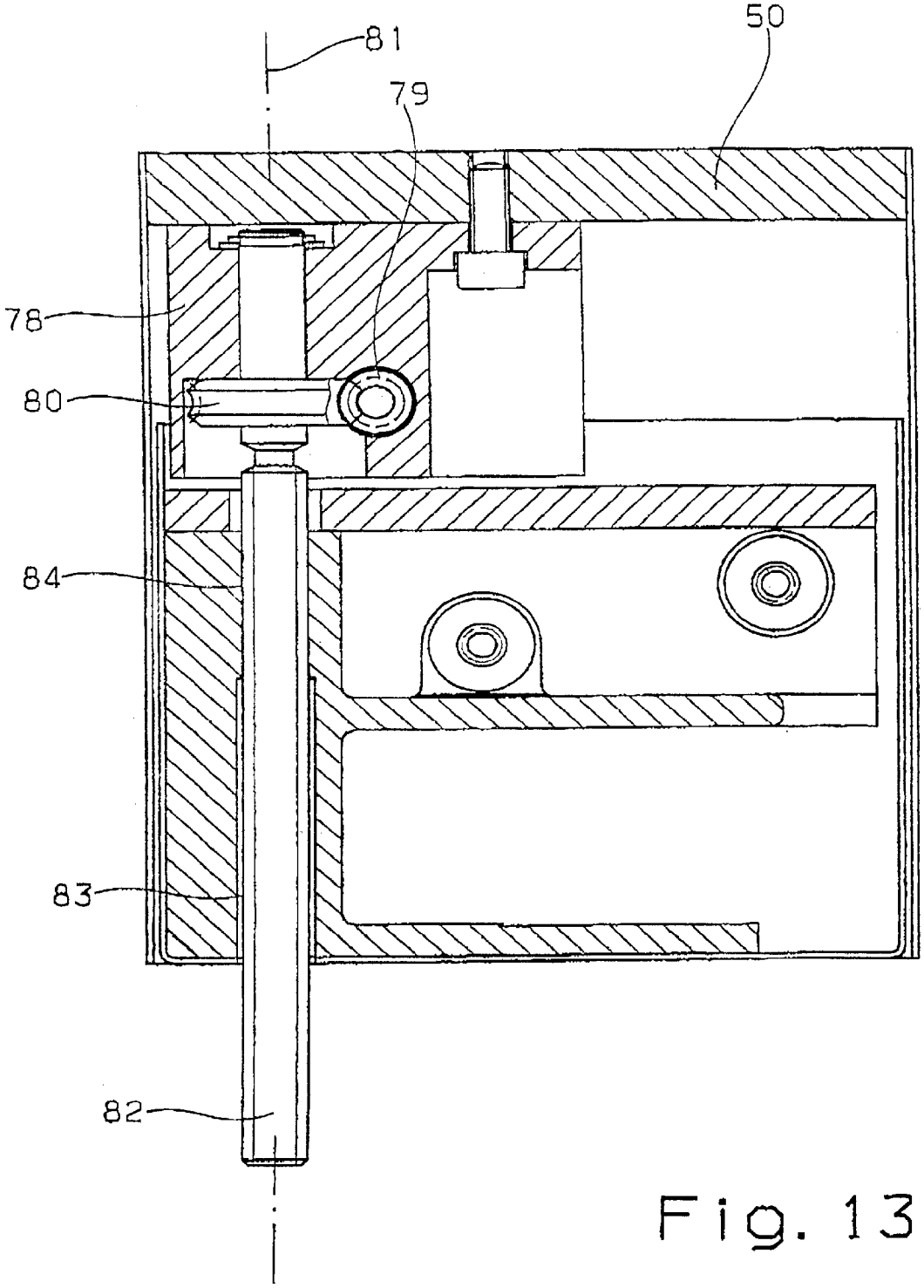
FIG. 13 is a schematic section along the line XIII—XIII of FIG. 12.

The up and down movement of the carriage 52 is effected according to FIGS. 12 and 13 with the aid of a further actuating motor 77, which is fixed on a mounting shoe 78 fixed to the base plate 50. A worm 79 is fixed on the drive shaft of the actuating motor 77 and engages with a worm wheel 80 mounted rotatably in the mounting shoe 78. The worm wheel 80 can rotate about an axis 81 parallel to the axis of rotation 1 (FIG. 1) and is connected coaxially to a threaded spindle 82. This passes through a passage 83 formed in the frame 53, which has an internally threaded section 84 matched to the threaded spindle 82 and passed through by this. On switching on the actuating motor 77 the threaded spindle 82 is driven by the worm 79 and the worm wheel 80 in one or the other direction of rotation, whereby the frame 53 can be moved up and down on the guide rods 51 (FIGS. 1, 4, 6) and with it the whole carriage 52, between the two extreme position seen in FIGS. 1 and 4. The actuating motor 77 is, like the actuating motors 63, to particular advantage a servo or stepping motor.

In order to detect the current position of the carriage 52 a sensor 86 is fixed on a bracket 85 (FIG. 6) of the frame 53, with which a number of position indicators 87*a, b, c* are associated. For example the two position indicators 87*a* and 87*c* are associated with the upper and lower extreme positions of the carriage 52 respectively while the middle position indicator 87*b* corresponds to an intermediate position of the carriage (FIG. 5) in which the coupling elements 72 of the actuating members 58 are located directly above the dial cam system 7, but still below the support ring 27. The action of the position indicators 87*a, b, c* is such that the sensor 86 provides an electrical signal when it is opposite them, which can be used to stop the carriage movement or switch off the actuating motor 77, when automatic control of the carriage movement is desired.

As is apparent especially from FIG. 12, sensors are also associated with the switch flags 76 of the actuating members 58. In particular in the embodiment two sensors 88*a* and 88*b* are associated with each switch flag 76 and are arranged on diametrically opposite sides of the axis 67 (FIG. 6) and are thus offset by 180° relative to one another. Each pair of sensors 88*a*, 88*b* serves the purpose of issuing an electric signal when the associated switch flag 76 is located in a rotary position defined by the one of the other of the sensors. The sensors 88 are mounted on the bracket 85 or on a further bracket 89 (FIG. 12) of the frame 53, where these brackets 85, 89 are fixed on the frame part 55 for example. The sensor 86 and the uppermost position indicator 87*a* are moreover visible in FIG. 12.

In a particularly preferred embodiment, the sensors 86 and 88 consist of inductive transducers, e.g. with coils, or induction switches and the switch flags 76 and position indicators 87 are permanent magnets associated therewith, so that arrangements in the nature of proximity switches result. Alternatively however, optical, capacitive sensors or sensors formed in the manner of Hall generators and corresponding switch flags 76 and position indicators 87 could be provided. Components of this kind are generally known to the man skilled in the art and generally known for example in machine tools, industrial robots, transfer lines and the automobile industry, and they do not therefore need to be described in more detail.

The supply of electric current to the various actuating motors 63, 77 and sensors 86, 88 is effected according to FIG. 1 by means of lines 90. These are connected in known manner to brushes 91, which contact slip rings 92 which extend coaxially round the axis of rotation in the centre of the circular knitting machine. The brushes 91 are fitted for example in a housing 93 fixed to the rotatable support plate 23, while the slip rings 92 are connected to a sleeve 94 surrounding the drive shaft 18 and connected to the stationary support plate 15.

Figure 14:
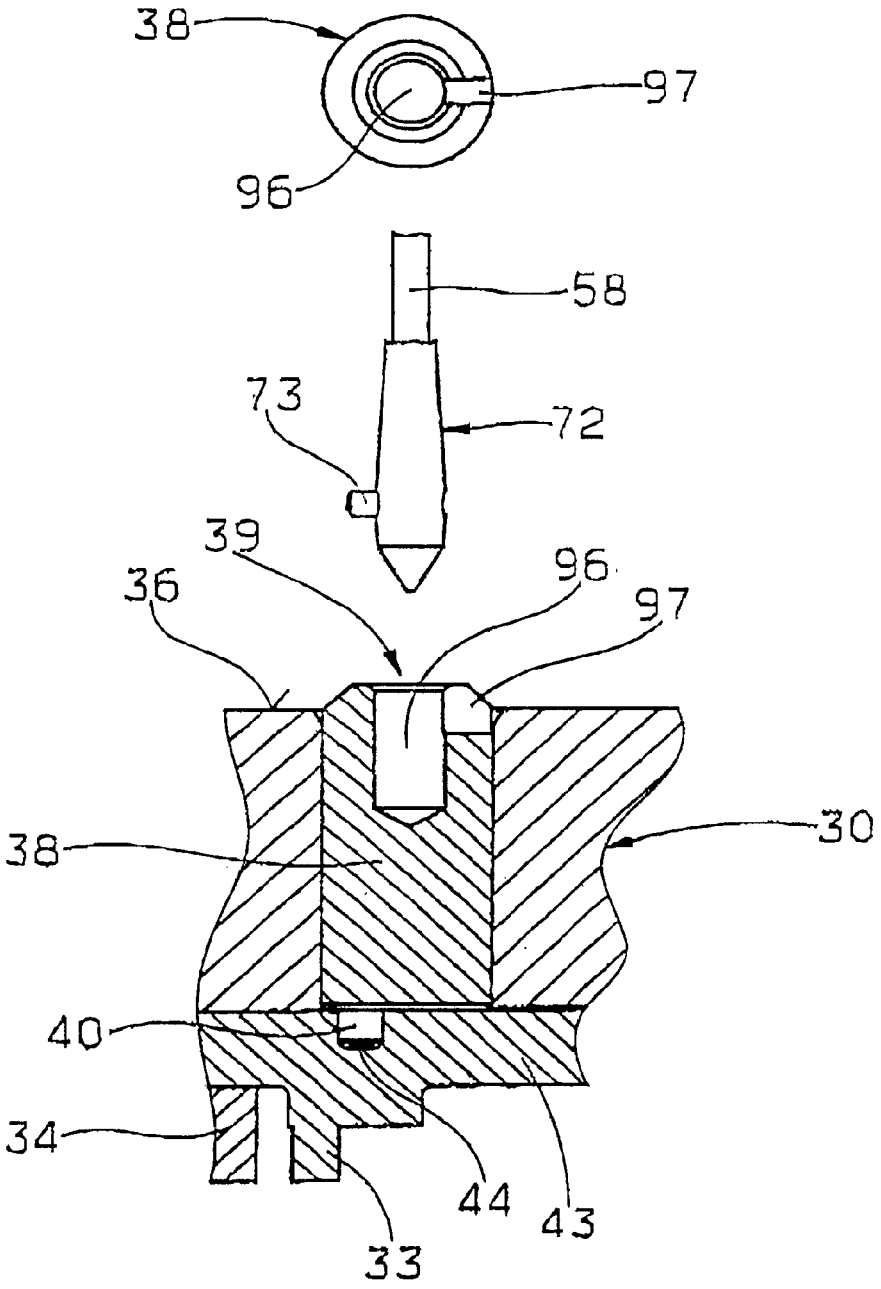
FIGS. 14 to 16 show the manner of operation of the setting device according to FIGS. 1, 4 and 6 in schematic views.
Figure 15:
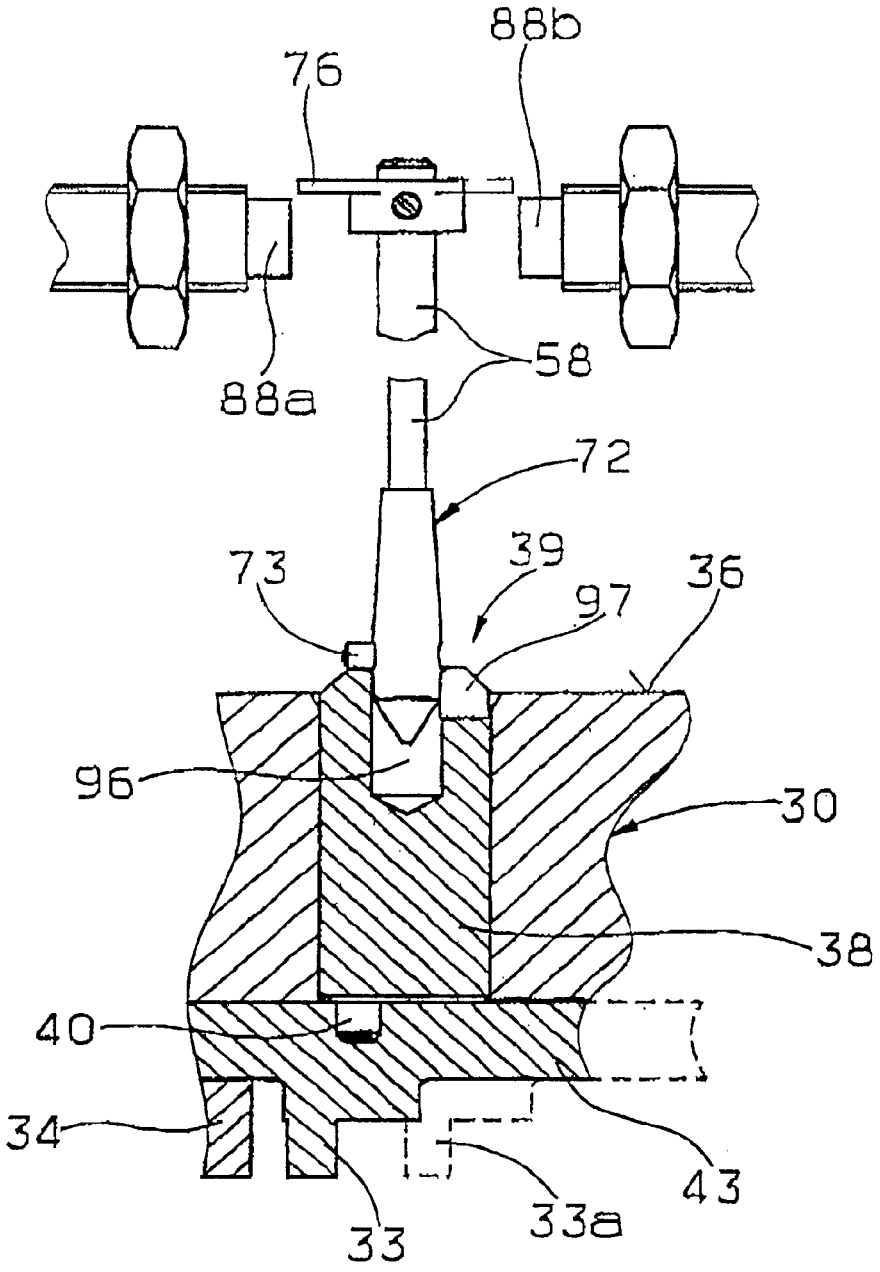
Figure 16:
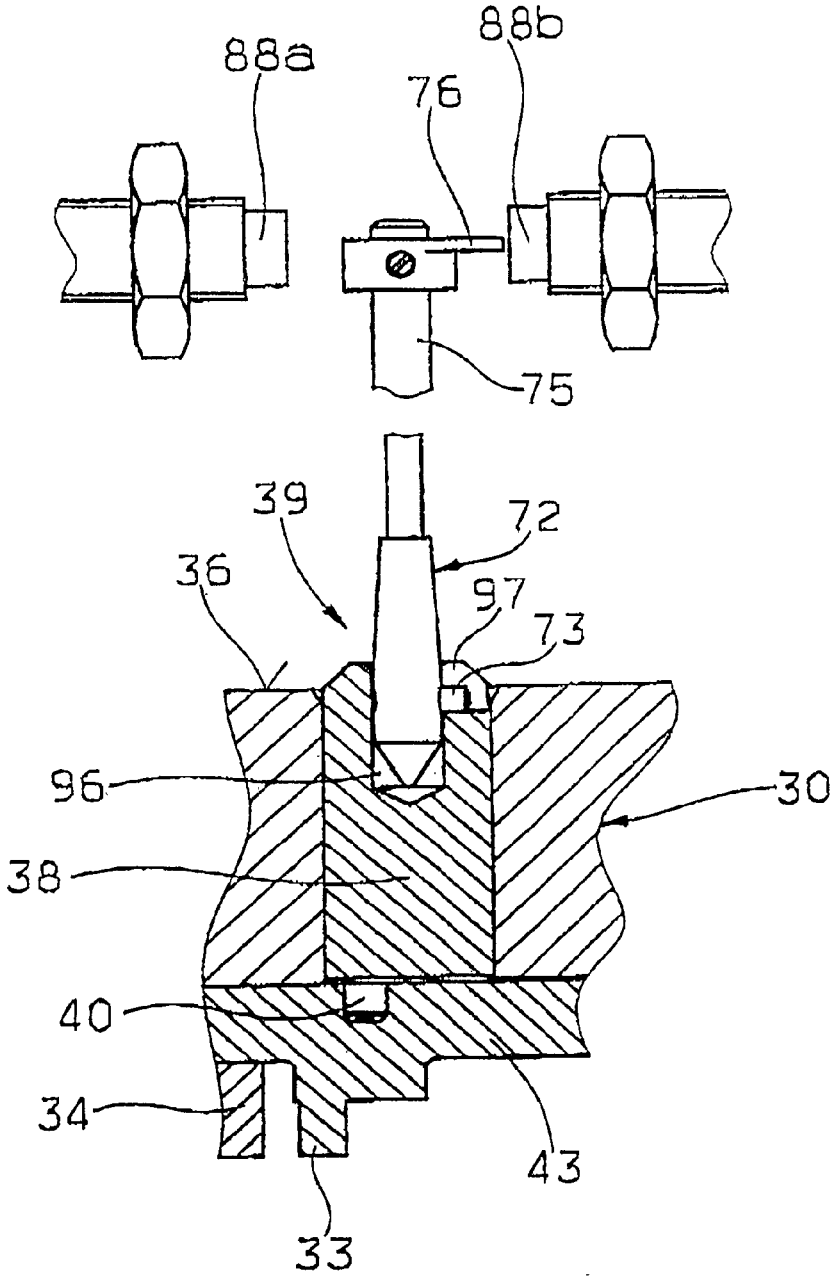

FIGS. 14 to 16 show inter alia, to a larger scale, one of the setting means 38 and its coupling element 39 (cf. also FIGS. 2 and 3). According to this the coupling element 39 consists essentially of a cylindrical blind bore 96 and a groove 97 opening radially into this, which is open to the rear end of the setting means 38. The blind bore 96 and the groove 97 serve to receive the shank form coupling element 72 and the pin 73 of the actuating member 58, where however the pin 73 can only latch into the groove 97 when the actuating member 58 has substantially a defined, preselected angular position with respect to the setting means 38, as FIG. 16 shows. It will be understood that the positions of the coupling elements 39, 72 could equally be interchanged, i.e. the coupling element 39 could be on the actuating member 58 and the coupling element 72 on the setting means 38.

The manner of operation of the described setting device 48 will now be described in more detail, essentially with reference to FIGS. 14 to 16 and for the example of the cam system part 33 according to FIG. 3.

A precondition for setting the described circular knitting machine to a new pattern, in that the cam system parts 32, 33 in some or all existing knitting systems are set in a new position, is the creation in the embodiment of a changeover location, i.e. a zone within the dial 4 free from needles or knitting implements 5. To this end as many adjacent knitting implements 5 are removed for unimpeded displacement of the cam system parts 32, 33 into their new positions then to be possible in the region of this changeover location. The changeover location is in the same position, as seen in the circumferential direction, as where the setting device 48 is arranged. Moreover the transmission ratio is preferably so selected through the pinion 24 (FIG. 1) that the support plate 23 and the dial 4 move in exact synchronism and with the same peripheral speed. This ensures that the changeover location always lies at the site of the setting device 48 regardless of the direction of rotation of the support plate 23. In circular knitting machines with cam system parts which can also be switched in the installed state of the knitting implements, the creation of the described changeover location is not necessary.

The setting device 48 is aligned with one of the segments 30 to be adjusted by common rotation of the dial 4 and the support plate 23 and is stopped there. This can be effected in that a pushbutton switch present as a rule in circular knitting machines for the so-called creep mode is actuated for example. In addition markers in the form of position indicators 98 (FIG. 1) can be applied to the support plate 23, the dial 4, the needle cylinder 2 or another rotatable part, which indicate in conjunction with a positionally fixed marker when the changeover location or the setting device 48 is aligned exactly with one of the cam system groups 30. Instead of the marker a sensor 99 (FIG. 1) could equally be associated with the position indicators 98 and be fixed on an upper cover 100 of the circular knitting machine and be so connected in a circuit including the pushbutton switch or another switch that the setting device 48 is automatically aligned with the respective next cam system group 30 on a single actuation of this switch and is then stopped in this position. The position indicators 98 and the sensor 99 can be formed like the position indicators 87 and sensors 88.

The setting of the cam system parts is now effected in that a switch in the circuit of the actuating motor 77 is actuated and the carriage 52 is thereby driven from its fully raised position into the fully lowered position according to FIG. 4. On reaching this position the actuating motor 77 is stopped manually or preferably by means of the position indicator 87*c* actuating the sensor 86 (FIG. 6).

The actuating members 58 are so aligned after alignment of the setting device 48 with one of the cam system groups 30 according to FIGS. 4 and 5 with the cam system parts 32, 33 that their axes 67 (FIG. 6) are coaxial with the axes of the respective setting means 38. The lower ends of the coupling elements 39 formed as lead-in bevels of the coupling elements 72 thus dip gradually into the associated coupling elements 39, insofar as the current angular setting of the pins 73 allows and as is schematically indicated in FIGS. 14 to 16 for the setting means 38 of one of the cam system parts 33. There are two possibilities. If the pin 73 is correctly aligned with the groove 97 of the associated coupling element 39 of the setting means 38, it enters therein and the actuating member 58 attains its lowermost position (FIG. 16). Since only a single such, defined coupling position is preferably possible, the two coupling elements 39, 72 assume a defined position relative to one another in this position. Accordingly the rotational position of the actuating member 58 which can be sensed with the aid of the associated switch flag 76 and the associated sensors 88*a, b* (FIG. 12) is at the same time an unambiguous measure of the rotary position of the cam system part 33. To this end the pin 73 preferably fits with a positive close tolerance in the groove 73 in the coupling position. If however the pin 73 is not correctly aligned with the associated groove 97 (FIG. 15), it bears on the rear end 36 of the cam system part 33 or of the setting means 38 during the lowering of the carriage 52 and is then gradually raised in the frame 53 against the force of the associated helical spring 74 (FIG. 6) during travel to the lowest carriage position. This movement is possible because the setting members 58 are mounted axially slidable in the associated drive sleeves 60.

In order to achieve latching of the pin 73 located in the position according to FIG. 15 into the groove 97, the associated actuating motor 63 (FIG. 12) is switched on after the carriage 52 has been fully lowered. The associated drive sleeve 60 and the actuating member 58 therewith are caused to rotate, whereby the pin 73 slides on the rear end 36 of the setting means 38, until it reaches the groove 97 and then snaps into this under the force of the helical spring 74 (FIG. 6). The actuating motors 63 of the other actuating members 58 present are operated when necessary in a similar way, until all pairs of coupling elements 39, 72 have been brought into engagement with one another in the coupling position defined by the pins 73 and the grooves 97.

Although the positioning motors 63 could basically be switched on long enough for all pairs of coupling elements 39, 72 to assume the desired coupling position by manual actuation of pushbutton switches or the like, this operation preferably takes place automatically and to particular advantage simultaneously for all actuating members 58 present, by use of suitable switches. These could for example be in the form of limit switches and be so arranged in a general control circuit of the setting device 48, that they are automatically switched on after reaching the lowest carriage position and in the existence of or on reaching the respective coupling position, which is signalled by the associated sensor 88*a, b* are switched off again.

The necessary preconditions for setting the cam system parts are achieved by producing the defined coupling positions. It is in fact possible so to rotate the actuating members 58 with the aid of the same means, namely the actuating motors 63 which are used to produce the defined coupling position, that the setting means 38 coupled thereto and connected positively at least in the direction of rotation are turned in one or the other direction of rotation. This rotation is effected essentially in just the same manner as must take place when the actuating members 58 or suitable tools for setting the cam system parts 32, 33 are used for manual setting. The switch flags 76 and sensors 88*a, b* can be used to monitor the respective set-point positions for the actuating members 58 or the corresponding setting means 38.

A particularly simple control of the various cycles of movement is then achieved if, as in the embodiment, each of the cam system parts 32, 33 can only assume two defined positions, which correspond to two defined settings of the setting means 38 offset from one another by 180°. Such a control is shown schematically in FIGS. 14 to 16, wherein the cam system part 33 either assumes its position shown in full lines or a position 33*a* shifted to the right, shown in FIG. 15 in broken lines, which corresponds to a position of the setting means 38 turned through 180°. Moreover the two sensors 88*a, b* are arranged at such a level that they can be excited by a switch flag 76 of an actuating member 58 only when its pin 73 is fully latched into the groove 72. On the other hand the sensors 88*a, b* are arranged at positions offset by 180° in such positions that they are always then excited by the switch flag 76 of the actuating member 58 when its pin 73 assumes one of the two rotational positions which are associated with the defined positions of the eccentric pins 40 on reaching the two end positions of the cam systems part 33. If the pin 73 contacts the setting means 38 as shown in FIG. 15 for example, the switch flag 76 is located outside the outside the range of action of the sensor 88*a,* which senses the left position of the switch flag 76 in FIG. 15. Since neither the sensor 88*a* nor the sensor 88*b* signals the presence of a switch flag 76 in this position, the absence of such a signal on reaching the deepest carriage position can be used as an indication that the two coupling elements 39, 72 have not latched together. This could lead in an automatic control to switching on the corresponding actuating motor 63, which begins to turn the actuating member 38, until it is in a position turned through 180° shown in FIG. 15 in broken lines, in which the sensor 88*a* does not however respond. Rather, this responds only when the coupling element 72 has snapped fully into the coupling element 39 in accordance with FIG. 16 and thus informs the electric circuit that the coupling operation is complete.

If the setting means 38 in FIGS. 14 to 16 were to be in a position rotated through 180°, the illustrated coupling element 72 would already latch in without additional rotation. Correspondingly a coupling element 72 which is located during lowering of the carriage 52 in a position rotated through 180° compared with FIG. 14 still has to be turned until it can latch into the coupling element 39. In each case it is possible to move an actuating member 58 which has not yet latched in after lowering the carriage 52 through a half or a full turn (or a multiple thereof) into such a position that the coupling elements 39, 72 come into engagement. Moreover the control circuit can be so designed that the rotary movement of the actuating member 58 terminates or does not even begin when one of the sensors 88*a, b* responds, because this corresponds each time to attaining a defined and known position of the actuating member 58.

The subsequent setting of the associated cam system part 33 can be effected automatically with the aid of a suitably programmed pattern device, in that this in known way issues a logical "0" signal when the cam system part 33 assumes or should assume the position seen in FIGS. 14 to 16, whereas it generates a logical "1" signal for example when the cam system part 33 should assume a position which corresponds in FIG. 15 to a rotation of the adjusting means 38 through 180°, i.e. the position 33*a.* After conclusion of the coupling operation it is then merely necessary so to test the sensors 88*a, b* to see which of the two the switch flag 76 is opposite (e.g. FIG. 16). If that is the sensor 88*b* then the corresponding actuating motor 63 is switched on for half a revolution of the setting means 38 when the cam system part 33 should be shifted into the position 3*a* according to FIG. 15, or is not switched on when it should remain in the position shown in FIG. 16. The corresponding procedure applies when the switch flag 76 faces the sensor 88*a* after completion of the coupling operation. Merely by comparing the actual state signals issued by the sensors 88*a, b* with the set-point signals provided by the pattern device a decision is possible as whether the associated actuating motor 63 has to be switched on or not, where the position rotated through 180° can he recognised in that the respective other sensor 88*a, b* responds on reaching that position, which can be utilised to switch off the actuating motor 63. The sensors 88*a, b* therefore monitor both the necessary switching on of the actuating motors 63 and also their switching off after turning the setting means 38 through 180°. The control is advantageously effected with the aid of modern microprocessors or sequence controllers, so that the coupling positions are firstly produced simultaneously for all four actuating members 58 and then the set-point positions are produced simultaneously in dependence on the pattern. It is an advantage that it is entirely immaterial in which position the setting means 38 and/or the actuating members 58 are before beginning the setting operation, while arbitrary intermediate positions between the two positions shown in FIG. 15 are possible.

Should one of the coupling elements 72 not latch into a corresponding coupling element 39 for any reason there is a fault, which is recognised in that neither of the two sensors 88*a, b* issues a position signal induced by the corresponding switch flag 76. An alarm signal can be issued in this case, which indicates the fault to the operator.

In order that the coupling operation shall also function reliably when the axes 67 (FIG. 6) of the actuating members 58 are not ideally coaxial with the setting means 38, the sections 71 (FIG. 6) of the actuating members 58 are preferably sufficiently thin or made from a sufficiently flexible material. They can then bend somewhat like a Cardan joint under the action of the wedge-formed lead-in bevels on the lower ends of the coupling elements 72 and thereby nevertheless lend to reliable latching in.

After the setting of the cam system group 30 in accordance with the pattern it is arranged that the carriage 52 is raised again by renewed actuation of the switch controlling the actuating motor 77 and the actuating members 58 are lifted out of the setting means 38. It is sufficient for this to raise the actuating members 58 into the intermediate position seen in FIG. 5, detectable by means of the sensor 87*b* (FIG. 6), whereafter the described setting routine is carried out for the segment 30 following in the direction of rotation of the dial 4. Raising the carriage 52 or the actuating members 58 between two setting operations into the fully inoperative position seen in FIG. 1 is only necessary when the setting device 48 has to pass one of the spokes 26 (FIGS. 1, 5) during the rotation of the dial 4. By means of position sensors corresponding to the position indicators 98 (FIG. 1) but fitted to the spokes 26 it can be ensured that passing a spoke 26 is only possible in the inoperative position shown in FIG. 1. The spokes are moreover advantageously so designed and arranged that they do not impede the setting of the segments 30 located directly thereunder.

After completion of the setting operation the carriage 52 is brought into the fully raised position. The knitting implements removed at the said changeover location can then be fitted again.

The total time for the setting of the described circular knitting machine with 72 systems can be reduced substantially by the setting device according to the invention. When using actuating motors 63, 77 customary in the trade only about a sixth of the previous setting time is needed.

A particular advantage of the invention lies in that the described setting device 48 does not have to be a fixed component of the circular knitting machine. Rather, it is possible to fix it removably to the circular knitting machine by means of the screws 49. It can then be mounted as required on any existing circular knitting machine to be converted and be used in the described way, insofar as the circular knitting machine is provided with a suitable support plate 23 and if required suitable position indicators 98 and sensors 99. In contrast to known machines the setting of the cam system parts 32, 33 can take place entirely independent of the position in which they are located before the setting operation.

The invention is not limited to the described embodiment, which can be modified in many ways. For example it is possible to use the actuating members 58 also on cam system parts which are slidably mounted perpendicular to the knitting implements 5, instead of parallel thereto and are fixed for this on suitably slidable pins having radial entraining devices guided in the segments 30. Setting means in the form of cylindrical studs mounted rotatably in the segments 30 can serve to set such cam system parts, acting on the entraining elements through helically rising and falling inclined surfaces on their peripheral sections (EP 0 694 640 A1). On rotating these studs by means of a tool the cam system parts are displaced by the inclined surfaces and optionally additional restoring springs. The setting device according to the invention can be used in just the same way on the studs with the inclined surfaces as described above for the example of the setting means in the form of eccentric studs. The sole difference lies in that the mechanics for the transmitting the rotary movement of the studs to the cam system parts is different. This moreover applies regardless of whether a changeover location free from knitting implements or a changeover location which consists of a plurality of adjacent knitting implements with shortened butts is provided, and/or whether two, three or more different positions of the cam system parts and therefore of the setting means also are provided. Moreover it is possible in both cases, especially when small amounts of fabric have to be made with different patterns, to allow the circular knitting machine to operate with a permanently present changeover location, since its width needs only to amount to about 30 mm as a rule.

In an alternative embodiment it would be further possible to dispense with the sensors completely. This applies especially if the setting means 38 abut a fixed stop in the segment 30 in both of the extreme positions spaced by 180° and therefore can only be turned to and fro between the two extreme positions. If the actuating members 58 are coupled to the setting means in such an embodiment in the described manner and then turned again, these automatically abut one of the two stops after one revolution at the most of the actuating member 58 in a selected direction of rotation, which makes further turning impossible. Destruction of the actuating members or setting means can be avoided in that the drive for the actuating members is provided with a slipping clutch. If all setting means lie against the said stop and are therefore all located as are the cam system parts coupled thereto in the same starting position, selected setting elements 38 can be turned by turning the actuating members in the opposite direction, until they abut the other of the two stops, the slipping clutches act and the associated cam system parts therefore assume a second defined position. The cam system parts associated with the setting means not turned backwards remain in contrast in the position corresponding to the first named stop. In this embodiment also, in that the actuating members and setting means can only be brought into engagement with one another in a defined coupling position, it is possible to produce the one or the other position of the cam system parts in dependence on a predetermined pattern with simple and automatically operable means, without it being necessary to know in which position the cam system parts and/or the actuating members had been before the beginning of the setting operation. Here also the actuating motors for the actuating members need only be switched on for as long as correspond to a full revolution of the actuating members to produce a defined starting position. A difference from the embodiments according to FIGS. 1 to 16 consists only to the extent that in the last described case the actuating motors need to be in the form of reversing motors, while in the first described case the motors can always be rotated in the same direction. Apart from this, it will be obvious that the movement of the actuating members required in the particular case and the transmission of the movement of the actuating members to the cam system parts can be effected with numerous means other than those described, while the nature of the coupling elements to be brought into engagement can be chosen quite differently in dependence on the specific ease. The same applies to the sensing means with which the various positions of the actuating members are sensed, i.e. in particular the switch flags 76 and the associated sensors 88.

Furthermore, it is clear that the setting device 48 according to the invention can be used also and/or solely for setting the cylinder cam system 6, whose cam system parts are equipped with suitable setting means. In this case it would for example merely be necessary so to arrange the setting device 48 in FIG. 1 that the axes 67 (FIG. 6) of the actuating members are arranged horizontally instead of vertically and for the carriage 52 also to be movably horizontally, so that it can be firstly be lowered vertically and then shifted horizontally and radially in the direction of the cylinder cam system. As in the case of setting the dial cam system, more or less than four actuating members could be provided in dependence on the number of cam system parts to be set. Moreover it would be possible so to form the setting device 48 that the cam system parts of more than one cam system group 30 could be set simultaneously.

Furthermore it is possible to drive the support plate 23 otherwise than synchronously with the dial 4. For example the drive for the support plate 23 could be stopped during normal production operation, in that the pinion 24 is uncoupled manually or automatically from the teeth of the support plate 23. The pinion 24 in FIG. 1 could be fixed on the drive shaft 12 for this by means of a fixing screw and when required be shifted axially thereon in one or the other direction. However, the described cycle of movement offers the particular advantage that the complete pattern change can be carried out fully automatically in a simple manner, in that a control circuit is so designed that all existing cam system groups 30 are presented and set one after the other after actuation of a start switch. Moreover the setting device could have its own current supply, e.g. in the form of a battery or the like, and all means needed for its control, so that control from the outside can be dispensed with. Finally it will be understood that the various features can also be used in combinations other than those illustrated and described.

It will be understood that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims:

1. A circular knitting machine comprising: at least one first part formed as a carrier (2, 4) and having knitting implements (3, 5) and an axis (10; a second part formed as a cam system (6, 7) and having cam system groups (30) distributed about said axis (1), said cam system groups each comprising at least one adjustable cam system part (32, 33) and a setting means (38) associated therewith; means (14) for rotating at least one of the two parts about the axis (1); and a setting device (48) which is alignable with the cam system groups, said setting device including at least one actuating member (58) adapted to adjust the cam system parts (32, 33) in accordance with a pattern and means (77–82) for moving said actuating member (58) into at least an operative position and an inoperative position, wherein said setting means (38) and said actuating member (58) have coupling elements (39, 72) which are engageable with one another in a defined coupling position, after alignment of the setting device (48) with one of the cam system groups (30) by movement or the actuating member (58) into the operative position, and wherein said setting device (48) has means (60–63) for setting each cam system part (32, 33) by movement of the actuating member (58) after having brought said coupling means into engagement with each other.

2. A circular knitting machine according to claim 1, wherein each cam system group (30) has a plurality of adjustable cam system parts (32, 33) and wherein said setting device (48) is provided with a number of actuating members (58).

3. A circular knitting machine according to claim 1, wherein said setting device (48) consists of a removably attached assembly.

4. A circular knitting machine according to claim 3 and further comprising a support ring (23) coaxial with said axis (1) for mounting said setting device (48) above said carrier (2, 4).

5. A circular knitting machine according to claim 4, wherein said the carrier is in the form of a dial (4) and the support ring (23) is arranged above the dial (4).

6. A circular knitting machine according to claim 1, wherein said setting means (38) consists of a pin rotatably mounted in the cam system group (30) and wherein said actuating member (58) is a component which is mounted rotatably in the setting device (48) and can be aligned coaxially with said pin.

7. A circular knitting machine according to claim 1, wherein one of the coupling elements (39) is a bore (96) with a radial groove (97) formed in the setting means (38) or the actuating member (58) and wherein said other coupling element (72) is a shank formed on the actuating member (58) or the setting means (38), fitting in the bore (96) and having a radially projecting pin (73) fitting in said groove (97).

8. A circular knitting machine according to claim 6 wherein said actuating member (58) is mounted axially slidably in said setting device (48) against the force of a spring (74).

9. A circular knitting machine according to claim 6, wherein said means for moving said actuating member (58) comprise a drive sleeve (60) mounted rotatably in said setting device (48) and an actuating motor for rotating the drive sleeve (60), wherein said actuating member (58) is arranged axially slidable but not rotatable within said sleeve (60).

10. A circular knitting machine according to claim 4, wherein said setting device (48) includes a base plate (50) which has guide rods (51) and which can be mounted on the support ring (23), and a carriage (52) mounted slidably on the guide rods (51), said actuating member (58) and said means (60–63) for moving it being mounted on said carriage.

11. A circular knitting machine according to claim 1, wherein said setting device (48) is provided with means for detecting a position of the cam system part (32, 33).

12. A circular knitting machine according to claim 11, wherein said means include at least one sensor (88*a, b*) for detecting a position of said actuating member (58).

13. A circular knitting machine according to claim 12, wherein a switch flag (76) fitted on the actuating member (58) is associated with said sensor (88*a, b*).

14. A circular knitting machine according to claim 1, wherein said carrier (2, 4) and said support ring (23) are rotatable and the cam system groups (30) are arranged stationary in the machine frame.

15. A circular knitting machine according to claim 14, wherein means (98, 99) are provided for detecting an angular position of said carrier (2, 4) and said support ring (23) relative to a machine frame.

16. A setting device for setting cam system parts (32, 33) having setting means (38) on a circular knitting machine, comprising: at least one actuating member (58) adapted to adjust the cam system parts (32, 33) in accordance with a pattern, means (77–82) for moving said actuating member (58) into at least an operative position and an inoperative position, coupling elements (39, 72) on said setting means (38) and said actuating member (58), wherein said coupling elements are bringable into engagement with one another in a defined coupling position, after alignment of the setting device (48) with one of the cam system groups (30) by movement of the actuating member (58) into the operative position, and means (60–63) for setting each cam system part (32, 33) by movement of the actuating member (58) after having brought said coupling means into engagement with each other.

* * * * *